US009593479B2

(12) United States Patent
Kang et al.

(10) Patent No.: US 9,593,479 B2
(45) Date of Patent: Mar. 14, 2017

(54) SOUND ABSORPTION SHEET WITH IMPROVED SOUND ABSORPTION FUNCTION AND METHOD FOR MANUFACTURING SAME

(71) Applicant: LG Hausys, Ltd., Seoul (KR)

(72) Inventors: Gil-Ho Kang, Gunpo-si (KR); Seong-Moon Jung, Daejeon (KR); Bong-Gyu Kang, Seoul (KR)

(73) Assignee: LG HAUSYS, LTD., Seoul (KR)

( * ) Notice: Subject to any disclaimer, the term of this patent is extended or adjusted under 35 U.S.C. 154(b) by 0 days.

(21) Appl. No.: 14/412,241

(22) PCT Filed: Jun. 25, 2013

(86) PCT No.: PCT/KR2013/005579

§ 371 (c)(1),
(2) Date: Dec. 31, 2014

(87) PCT Pub. No.: WO2014/007480

PCT Pub. Date: Jan. 9, 2014

(65) Prior Publication Data

US 2015/0176269 A1 Jun. 25, 2015

(30) Foreign Application Priority Data

Jul. 4, 2012 (KR) ..... 10-2012-0072757

(51) Int. Cl.
*G10K 11/162* (2006.01)
*G10K 11/168* (2006.01)
(Continued)

(52) U.S. Cl.
CPC ..... *E04B 1/8209* (2013.01); *D06M 15/248* (2013.01); *D06M 23/16* (2013.01); *E04B 1/8409* (2013.01); *G10K 11/172* (2013.01)

(58) Field of Classification Search
CPC .... G10K 11/162; G10K 11/168; D21H 27/20; D21H 13/14; D21H 13/40; D21H 13/10; E04B 1/82
(Continued)

(56) References Cited

U.S. PATENT DOCUMENTS 6,613,424 B1 * 9/2003 Putt ..... B32B 13/04 106/122
7,311,957 B2 * 12/2007 Bargo, II ..... E04B 1/86 428/74
(Continued)

FOREIGN PATENT DOCUMENTS

CN 101194077 A 6/2008
DE 195 02 376 A1 3/1996
(Continued)

OTHER PUBLICATIONS

International Search Report for PCT/KR2013/005579 mailed on Sep. 5, 2013.
(Continued)

*Primary Examiner* — Edgardo San Martin
(74) *Attorney, Agent, or Firm* — Hauptman Ham, LLP

(57) ABSTRACT

Provided is a sound absorption sheet comprising an improved micro-resonance layer formed by means of a porous substrate and printing. The method for manufacturing a sound absorption sheet comprises the steps of: preparing a porous substrate; forming a micro-resonance layer by printing on the upper part of the porous substrate; and drying the micro-resonance layer.

15 Claims, 6 Drawing Sheets

(51) Int. Cl.

| | |
|---|---|
| ***E04B 1/82*** | (2006.01) |
| ***G10K 11/172*** | (2006.01) |
| ***D06M 15/248*** | (2006.01) |
| ***D06M 23/16*** | (2006.01) |
| ***E04B 1/84*** | (2006.01) |
| *G10K 11/16* | (2006.01) |

(58) Field of Classification Search
USPC ..... 181/293, 286, 290, 294
See application file for complete search history.

(56) References Cited

U.S. PATENT DOCUMENTS

| | | | | |
|---|---|---|---|---|
| 9,376,810 | B2 * | 6/2016 | Kemp | B32B 5/26 |
| 2008/0008869 | A1 * | 1/2008 | Good | B29C 44/12 428/311.51 |
| 2014/0124119 | A1 * | 5/2014 | Kim | B32B 38/0012 156/62.8 |

FOREIGN PATENT DOCUMENTS

| | | | | | |
|---|---|---|---|---|---|
| EP | 1362965 | A1 | | 11/2003 | |
| GB | 2478331 | A | | 9/2011 | |
| JP | 07054475 | A | | 2/1995 | |
| JP | 07060890 | A | * | 3/1995 | B32B 7/02 |
| JP | 2008285969 | A | | 11/2008 | |
| KR | 100753960 | B1 | | 8/2007 | |
| KR | 20100032668 | A | | 3/2010 | |
| KR | 20120024063 | A | | 3/2012 | |
| TW | 265750 | | | 12/1995 | |

OTHER PUBLICATIONS

Taiwanese Office Action dated Aug. 31, 2015 in connection with the counterpart Taiwanese Patent Application No. 1042118166001.
Office Action issued Nov. 4, 2016 from SIPO in connection with the counterpart Chinese patent application No. 201380035712.0. Total 15 pages including English translation.

* cited by examiner

SOUND ABSORPTION SHEET WITH IMPROVED SOUND ABSORPTION FUNCTION AND METHOD FOR MANUFACTURING SAME

TECHNICAL FIELD

The present invention relates to a sound absorption sheet with improved sound absorption capability and a method for manufacturing the same.

CROSS REFERENCE TO RELATED APPLICATION

This application claims the priority of Korean Patent Application No. 10-2012-0072757, filed on Jul. 4, 2012 in the KIPO (Korean Intellectual Property Office). Further, this application is the National Phase Application of International Application No. PCT/KR2013/005579 filed Jun. 25, 2013, which designates the United States and was published in Korean. Both of the priority documents are hereby incorporated by reference in their entireties.

BACKGROUND ART

As recent improvement in standard of living has led to growing demand for a pleasant life, acoustic design for buildings becomes important. Currently, sound-proofing panels having sound absorption capability so as to absorb a variety of interior noise are used as interior materials for buildings. Moreover, a variety of sound absorption sheets and sound absorption panels including the sound absorption sheets are used in fields that require a sound-proofing function, such as interior and exterior materials for car seats.

A sound absorption sheet generally requires permeability and sound absorption capability in order to minimize noise, and requires excellent permeability in order to maximize sound absorption effects. Thus, the sound absorption sheet requires a number of perforations to block noise.

Korean Patent No. 10-0753960 discloses a multilayer sheet for interior materials of vehicles with excellent strength and sound absorption/heat insulating capabilities, which includes a matrix formed by mixing thermoplastic resin fibers and natural fibers, and is fabricated using a conveyer belt composed of a number of perforated plates to form perforations. However, this patent does not describe any improved function of the multilayer sheet formed with pores.

DISCLOSURE

Technical Problem

It is an aspect of the present invention to provide a sound absorption sheet with improved sound absorption capability, which includes a micro-resonance layer.

It is another aspect of the present invention to provide a method for manufacturing the sound absorption sheet.

Technical Solution

In accordance with one aspect of the present invention, a sound absorption sheet includes: a porous substrate; and a micro-resonance layer formed by printing.

The micro-resonance layer may include a plurality of sound absorption holes penetrating both surfaces thereof.

The micro-resonance layer may include at least one selected from among a vinyl chloride sol, a urethane resin, an acrylic resin, and a vinyl resin.

The porous substrate may include at least one selected from among glass fibers, cellulose fibers, pulps, and synthetic organic fibers.

The porous substrate may have a basis weight of about 30 $g/m^2$ to about 500 $g/m^2$.

The porous substrate may have an air permeability of about 50 $L/m^2/S$ to about 1200 $L/m^2/s$ at a pressure of 50 Pa.

The porous substrate may have an average pore size of about 10 μm to about 60 μm.

The sound absorption sheet may have an average sound absorption coefficient of about 0.4 or more, as measured in a frequency band of about 200 Hz to about 2000 Hz.

The sound absorption sheet may have an air permeability of about 50 $L/m^2/S$ to about 1200 $L/m^2/s$ at a pressure of 100 Pa.

In accordance with another aspect of the present invention, a method for manufacturing a sound absorption sheet includes: preparing a porous substrate; forming a micro-resonance layer on top of the porous substrate by printing; and drying the micro-resonance layer.

The printing may include rotary screen printing.

The rotary screen printing may include injecting a composition for forming the micro-resonance layer into a rotary screen roll, and the rotary screen roll may include a micro-sound absorption screen.

The micro-sound absorption screen may control a diameter of sound absorption holes, a ratio of the sound absorption holes per unit area, or a pitch between the sound absorption holes according to frequency bands.

Advantageous Effects

According to one embodiment of the present invention, it is possible to design a sound absorption sheet including various micro-resonance layers according to frequency bands, and to achieve a high noise reduction coefficient (NRC).

According to another embodiment of the present invention, as the sound absorption sheet includes a micro-resonance layer, it is possible to achieve continuous production and remarkable cost-reduction.

BEST MODE

Hereinafter, embodiments of the present invention will be described in detail with reference to the accompanying drawings. It should be understood that the following embodiments are provided for illustration only and are not to be construed in any way as limiting the present invention. The scope and sprit of the present invention should be defined only by the accompanying claims and equivalents thereof.

Sound Absorption Sheet

One embodiment of the present invention provides a sound absorption sheet, which includes: a porous substrate and a micro-resonance layer formed by printing.

Figure 1:
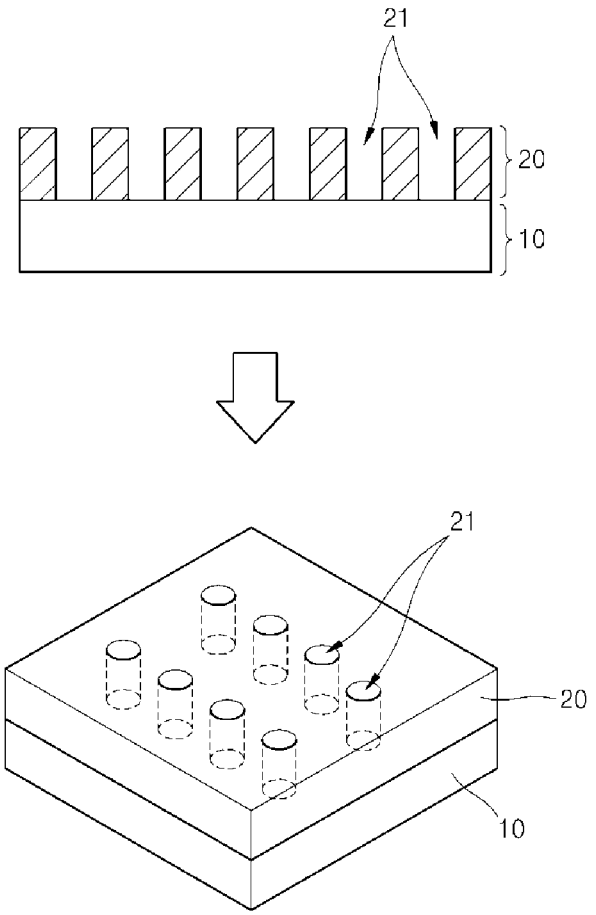
FIG. 1 is a side view of a sound absorption sheet according to one embodiment of the present invention.

Referring to FIG. 1, a sound absorption sheet 100 according to one embodiment of the invention may include a porous substrate 10 and a micro-resonance layer 20 formed by printing. The micro-resonance layer 20 may include a plurality of sound absorption holes 21 penetrating both surfaces thereof.

Due to an inherent porous structure of the substrate, the porous substrate 10 can affect sound absorption properties in high frequency bands or can maintain sound absorption capability of a sound absorption material. The porous substrate 10 may include at least one selected from among glass fibers, cellulose fibers, pulps, and synthetic organic fibers.

The glass fibers are formed by melting glass, which includes $SiO_2$ as a main component, followed by processing the molten glass into fibers. According to manufacturing method and usage, the glass fibers are categorized into long fibers and short fibers. As the diameter of the glass fibers decreases, the glass fibers exhibit better properties in terms of tensile strength and thermal conductivity. For heat reservation/sound absorption, glass fibers having a diameter of about 5 μm to about 20 μm are generally used. For filtering, fibers having a diameter of about 40 μm to about 150 μm are generally used.

The cellulose fibers are generally categorized into natural fibers and other fibers prepared using the natural fibers as a raw material. Typically, the cellulose fibers include wood fibers, cotton fibers, hemp fibers, Rayon, and the like. The cellulose fibers generally take the form of woven fabrics or knitted fabrics. In addition, the cellulose fibers may be used in a mixed form with other synthetic fibers, such as polyesters. Textile products prepared using a mixture of the cellulose fibers and synthetic fibers may be provided in the form of mixed yarns, blended fabrics, mixed fabrics, or knitted fabrics.

The pulp is an aggregate of cellulose fibers obtained from wood or other fiber plants through a mechanical process, a chemical process, or a combination thereof. The substrate may be prepared by compressing and bonding the pulp. The synthetic organic fibers may be selected from among polyester, polyethylene (PE), polypropylene (PP), ethylene-styrene copolymer (ES), cycloolefin, polyethylene terephthalate (PET), polyvinyl alcohol (PVA), ethylene-vinyl acetate (EVA), polyethylene naphthalate (PEN), polyether ether ketone (PEEK), polycarbonate (PC), polysulfone, polyimide (PI), polyacrylonitrile (PAN), styreneacrylonitrile (SAN), and polyurethane (PU). Specifically, the synthetic organic fibers may be composed of PVA.

More specifically, the porous substrate may be formed of a mixture of glass fibers and pulp and may be prepared in the form of paper. Examples of commercially available products may include GP-50G of Hankuk Carbon Co., Ltd. (based on a basis weight of 50 $g/m^2$, which may be controlled as needed), without being limited thereto.

The porous substrate 10 may have a basis weight of about 30 $g/m^2$ to about 500 $g/m^2$. The basis weight refers to mass (g) of the porous substrate per unit area (1 $m^2$). Within this range, the porous substrate 10 can maintain its sound absorption capability and there is no possibility of making it difficult to commercialize the sound absorption sheet due to excess increase in weight, or excessively increasing production costs. The porous substrate 10 may have a thickness of about 0.1 mm to about 7 mm. Within this range, there is no possibility of degrading quality of the porous substrate as an effective component, lowering usability of the porous substrate, or making it difficult to commercialize the sound absorption sheet.

The porous substrate 10 may have an average pore size of about 10 μm to about 60 μm, and an air permeability of about 50 $L/m^2/s$ to about 1200 $L/m^2/s$ at a pressure of 50 Pa. Typically, the porous substrate having lower air permeability can fail to provide proper insulation or sound absorption effects.

Therefore, the porous substrate 10 can secure sound absorption capability when the porous substrate has the average pore size and the air permeability within the above ranges. Specifically, when the porous substrate 10 has relatively low air permeability within the above range, the porous substrate 10 exhibits excellent sound absorption capability in a high frequency band. When the porous substrate 10 has relatively high air permeability within the above range, the porous substrate 10 exhibits excellent sound absorption capability in a low frequency band. Thus, it is possible to control the air permeability and the average pore size of the porous substrate 10 according to frequency bands.

The micro-resonance layer 20 may be formed on the porous substrate 10 by printing. As the sound absorption sheet includes the micro-resonance layer 20, the sound absorption sheet has a resonator structure for efficiently reducing noise.

In order to maintain the resonator structure, the micro-resonance layer 20 may include a plurality of sound absorption holes 21 penetrating both surfaces thereof. Here, the sound absorption sheet includes the plurality of sound absorption holes, thereby providing not only a soundproofing function but also an additional function of preventing vibration by absorbing noise.

In general, the micro-resonance layer may include perforations formed by perforation methods such as punching, drilling, laser etching, and the like. When the perforations are formed by such perforation methods, the micro-resonance layer can be crushed or torn, thereby causing deterioration in sound absorption capability of the sound absorption sheet.

According to the present invention, the micro-resonance layer 20 is formed by printing and may include a plurality of sound absorption holes penetrating both surfaces thereof. Unlike typical methods having limitation in size and ratio of the perforations, the present invention can control the diameter of the sound absorption holes, the ratio of the absorption holes per unit area and the pitch between the sound absorption holes according to frequency bands. In addition, as the micro-resonance layer 20 including the plurality of sound absorption holes 21 formed by printing enables continuous production, it is possible to achieve cost reduction in manufacture of sound absorption sheets or panels.

Specifically, as the micro-resonance layer is formed by rotary printing, in which a composition for forming the micro-resonance layer, such as a polyvinyl chloride (PVC) sol, is deposited on the top of the porous substrate 10, it is possible to omit the process of bonding the porous substrate to the micro-resonance layer formed with the perforations, which is performed in a typical method of manufacturing the sound absorption sheet.

More specifically, since a typical micro-resonance layer is formed by perforation methods such as punching, drilling, laser processing, etching, and the like, only the micro-resonance layer with perforations having a wide diameter and a low porosity can be obtained. However, as described above, according to the present invention, the micro-resonance layer is formed by printing and has sound absorption holes having a narrower diameter and a larger ratio of the holes per unit area, thereby realizing formation of the micro-resonance layer having the largest resonator structure at minimum costs.

The micro-resonance layer may be formed using almost all kinds of polymers. The micro-resonance layer may be formed of a thermoplastic resin undergoing cross-linking reaction by heat, or may be formed of foam. In some embodiments, the material for forming the micro-resonance layer may further include a plasticizer, a stabilizer, fillers, a curing catalyst, a cross-linking agent, a binder, a flame retardant, and the like. A specific example of the thermoplastic resin may include at least one selected from among a vinyl chloride sol, a urethane resin, an acryl resin, a vinyl resin, and the like.

For example, the plurality of sound absorption holes may be arranged in a predetermined pattern. Specifically, an embossed pattern may be provided to the micro-resonance layer formed with the plurality of patterned sound absorption holes. Here, the embossed pattern is formed by arranging shapes selected from among a polygonal shape, a circular shape, an oval shape, and combinations thereof, and is not limited to a circular shape. In addition, the embossed pattern may also include a stripe pattern, and may be formed by continuously repeating shapes selected from among a polygonal shape, a circular shape, an oval shape, and combinations thereof.

Since the micro-resonance layer 20 having such an embossed pattern is formed on the surface of the porous substrate 10, the sound absorption sheet 100 can impart various appearances to the surfaces of the sound absorption sheet and panel. In addition, since the plurality of sound absorption holes 21 is formed by printing, the sound absorption sheet 100 can secure flame resistance while maintaining constant air permeability and noise reduction coefficient.

Like the embossed pattern having various shapes, the sound absorption hole 21 may have a shape selected from among a polygonal shape, a circular shape, an oval shape, and combinations thereof, without being limited thereto. The sound absorption holes may have various shapes according to the shape of the embossed pattern and may also have a stripe pattern.

The sound absorption holes may have an average diameter of about 0.1 mm to about 20 mm. Here, the average diameter refers to an average diameter of the sound absorption holes penetrating both surfaces of the micro-resonance layer, and there is no limitation as to the shape of the sound absorption holes. According to the embossed pattern of the micro-resonance layer, the shape of the sound absorption holes may vary. The average diameter of the sound absorption holes may refer to a diameter of a circle in the case where the sound absorption holes have a circular shape in plan view, a length of one side where the sound absorption holes have a rectangular shape in plan view, and a width of a stripe in the case where the sound absorption holes have a stripe shape in plan view.

The ratio of the sound absorption hole 21 per unit area may range from about 1% to about 60%. This ratio is obtained by dividing an area occupied by the sound absorption holes per unit area, specifically an area occupied by the plurality of sound absorption holes penetrating both surfaces of the micro-resonance layer, by the unit area. By maintaining the ratio within this range, the micro-resonance layer including the sound absorption holes can improve sound absorption capability in both high frequency bands and low frequency bands.

In addition, a distance between the sound absorption holes 21 may range from about 0.5 mm to about 50 mm. The distance between the sound absorption holes 21 is also referred to as pitch and means a distance from the center of one sound absorption hole to the center of another sound absorption hole closest thereto, regardless of the shape of the sound absorption holes. By maintaining the pitch within this range, the micro-resonance layer including the sound absorption holes can improve sound absorption capability in both high frequency bands and low frequency bands.

The sound absorption sheet 100 according to the embodiment of the invention includes the porous substrate and the micro-resonance layer formed with the plurality of sound absorption holes penetrating both surfaces thereof. The sound absorption sheet has sound absorption capacity represented by an average noise reduction coefficient of 0.4 or more, as measured in a frequency band of about 200 Hz to 2000 Hz.

The noise reduction coefficient ranges from 0 to 1. As the noise reduction coefficient approaches 1, the sound absorption sheet exhibits better sound absorption capacity. Generally, a sound absorption material has a noise reduction coefficient of about 0.3. In the case where a certain material has a noise reduction coefficient of about 0.4 or more, it can be accepted that the material has excellent sound absorption capacity. In general, sound absorption coefficients are established based on several frequencies and an average noise reduction coefficient is obtained by calculating an average value of the sound absorption coefficients. The sound absorption sheet indicates an average noise reduction coefficient of about 0.4 or more, implying that the sound absorption sheet has excellent sound absorption capability.

The sound absorption sheet 100 may have an air permeability of about 50 $L/M^2/s$ to about 1200 $L/M^2/s$ at a pressure of 100 Pa. Within this range of the air permeability, the sound absorption sheet can achieve constant porosity, thereby improving sound absorption capability.

Specifically, when the sound absorption sheet has an air permeability of less than about 50 $L/M^2/s$ at a pressure of 100 Pa, the sound absorption capacity of the sound absorption sheet can be reduced at a frequency of about 1800 Hz or higher. When the sound absorption sheet has an air permeability of greater than about 1200 $L/M^2/s$, the sound absorption capacity of the sound absorption sheet can be reduced at a frequency band of about 1600 Hz or lower. Accordingly, the sound absorption sheet comprising the micro-resonance layer can exhibit remarkably improved sound absorption capacity by maintaining the air permeability within the above range.

The sound absorption sheet may be used in a variety of fields to absorb sound and noise. For example, the sound absorption sheet may be used as a sound absorption panel for buildings and interior decoration, and interior and exterior materials for vehicles, specifically to absorb sound and noise from an engine compartment of the vehicles. In addition, the sound absorption sheet may also be applied to electric and electronic equipment. The weight and manufacturing costs of the sound absorption sheet increase with increasing thickness of the sound absorption sheet. Thus, the thickness and weight of the sound absorption sheet may be suitably controlled in order to reduce the size and manufacturing costs of equipment or products employing the sound absorption sheet.

Method for Manufacturing Sound Absorption Sheet

Another embodiment of the present invention provides a method for manufacturing a sound absorption sheet including: preparing a porous substrate; forming a micro-resonance layer by printing on a top of the porous substrate; and drying the micro-resonance layer.

Conventionally, in order to form sound absorption holes in the sound absorption sheet, a conveyer belt including a plurality of perforated plates is used. Otherwise, perforations are formed by continuous punching, drilling, laser processing, or etching. In this case, considerable limitations are imposed on the diameter and porosity of the perforations and a pitch between the perforations. In addition, manufacturing costs increase with increasing number of perforations in manufacture of the sound absorption sheet including the resonance layer, thereby causing deterioration in efficiency of the manufacturing process.

However, according to this embodiment, the micro-resonance layer may be formed by printing. The printing method may include rotary screen printing. Rotary screen printing is simple and easy, thereby reducing manufacturing costs. In addition, rotary screen printing minimizes the diameter of the sound absorption holes, whereby the ratio of the sound absorption holes per unit area can be maximized, thereby allowing the micro-resonance layer to have an excellent resonator structure, and securing sound absorption and soundproofing effects.

Specifically, a production speed of 20 m/min or more is maintained using rotary screen printing, thereby enabling mass production of the sound absorption sheet while securing sound absorption capability of the sound absorption sheet.

Figure 2:
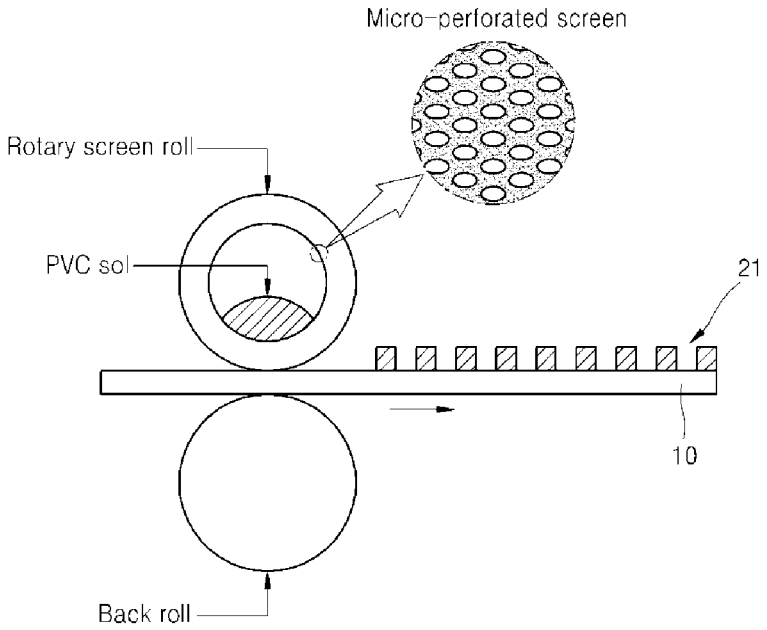
FIG. 2 is a schematic view showing a method for manufacturing the sound absorption sheet according to one embodiment of the present invention.
Figure 3:
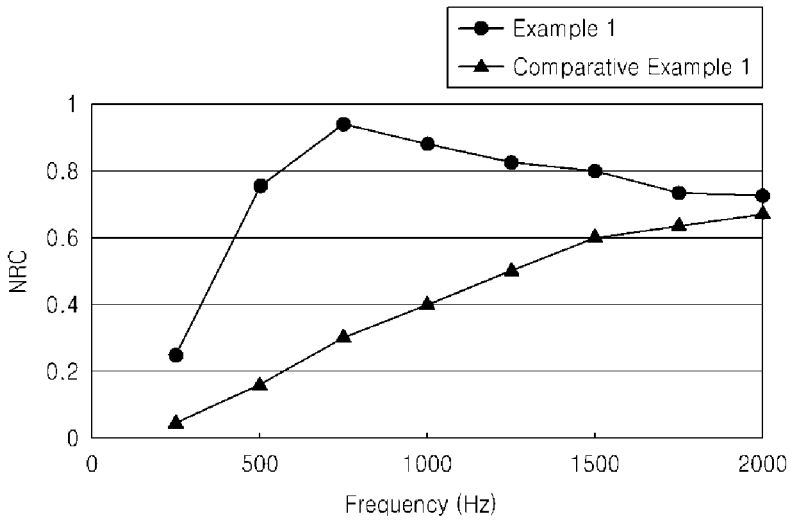
FIG. 3 is a graph depicting NRC according to frequency in Example 1 and Comparative Example 1.
Figure 4:
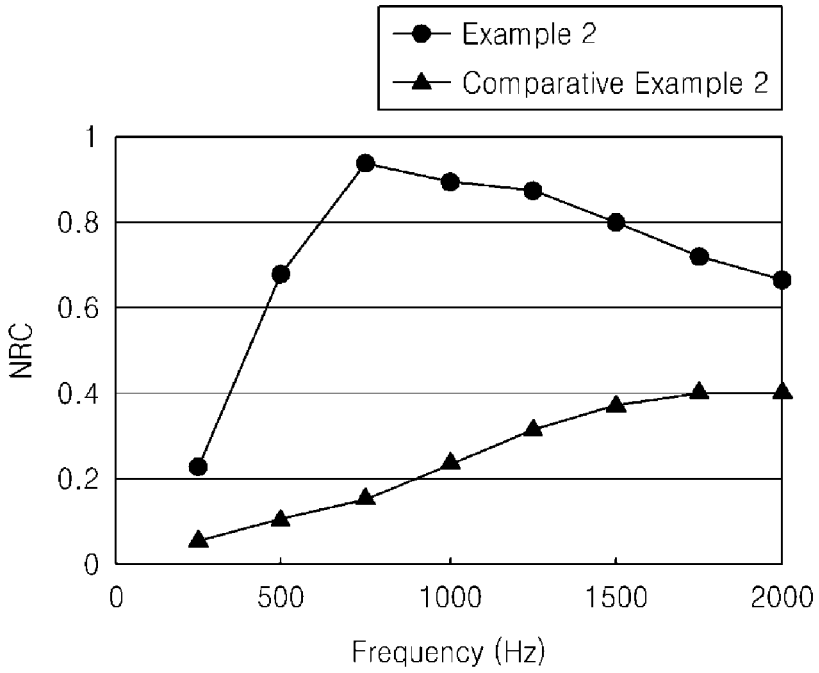
FIG. 4 is a graph depicting NRC according to frequency in Example 2 and Comparative Example 2.
Figure 5:
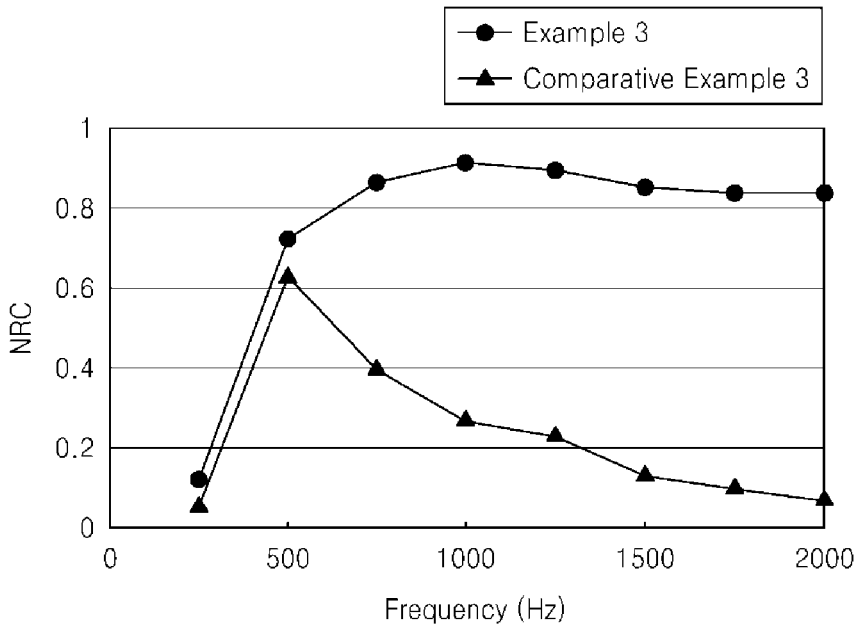
FIG. 5 is a graph depicting NRC according to frequency in Example 3 and Comparative Example 3.
Figure 6:
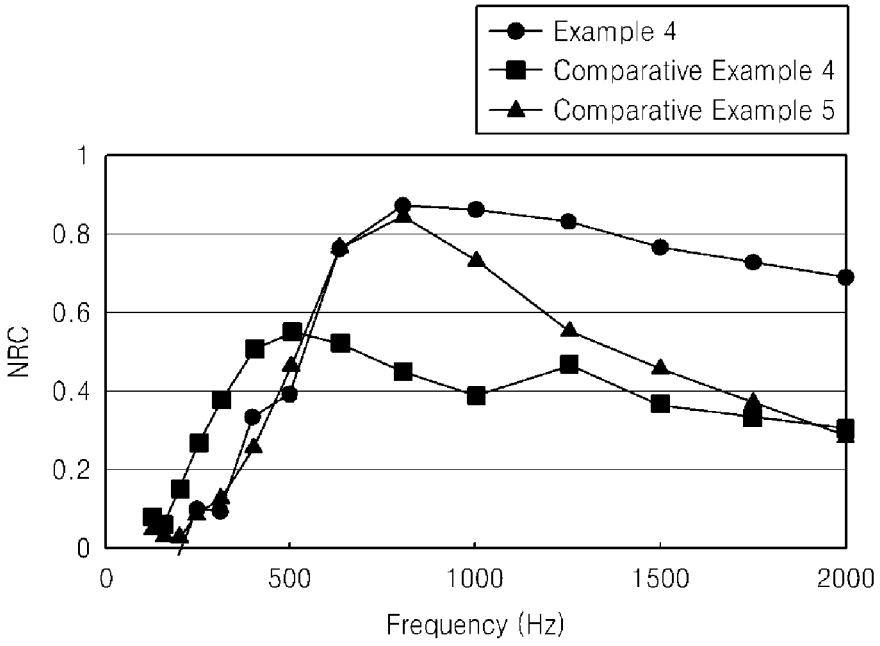
FIG. 6 is a graph depicting NRC according to frequency in Example 4 and Comparative Examples 4 and 5.

Referring to FIG. 2, rotary screen printing is schematically illustrated. Rotary screen printing includes injecting a composition for forming a micro-resonance layer into a rotary screen roll, which may include a micro-sound absorption screen. More specifically, a porous substrate is passed through a gap between a back roll and a rotary screen roll, and the composition is injected towards the top of the porous substrate by rotary screen printing. As a result, the micro-resonance layer can have a resonator structure including a plurality of sound absorption holes penetrating both surfaces thereof.

The sound absorption holes formed on the top of the porous substrate may be controlled by the micro-sound absorption screen. Specifically, the micro-sound absorption screen may control the diameter of the sound absorption holes, the ratio of the sound absorption holes per unit area or a pitch between the sound absorption holes according to frequency bands.

The micro-resonance layer may include at least one selected from among a vinyl chloride sol, a urethane resin, an acrylic resin, and a vinyl resin, as described above. Here, the composition for forming the micro-resonance layer may also include these components.

Hereinafter, the present invention will be described in more detail with reference to some examples. It should be understood that these examples are provided for illustration only and are not to be construed in any way as limiting the present invention.

Example 1

A porous substrate was prepared in the form of a glass paper sheet having a basis weight of 80 g/m$^2$ using a mixture of 40% of glass fibers having a fiber diameter of about 5 μm to about 20 μm and a fiber length of about 1 mm to about 50 mm, 55% of pulp, and 5% of PET fibers, and a micro-resonance layer was formed on top of the porous substrate by rotary screen printing. Then, the porous substrate was passed through a gap between a back roll and a rotary screen roll to which a PVC sol was injected. As the PVC sol passed through a micro-sound absorption screen in the rotary screen, a micro-resonance layer formed with a plurality of sound absorption holes penetrating both surfaces thereof was printed on the top of the porous substrate, thereby manufacturing a sound absorption sheet. Specifically, the diameter of the sound absorption holes and the ratio of the sound absorption holes per unit area were adjusted to 0.5 mm and 20%, respectively.

Example 2

A sound absorption sheet was manufactured in the same manner as in Example 1 except that the diameter of the sound absorption holes and the ratio of the sound absorption holes per unit area were adjusted to 1.5 mm and 25%, respectively.

Example 3

A sound absorption sheet was manufactured in the same manner as in Example 1 except that the diameter of the sound absorption holes and the ratio of the sound absorption holes per unit area were adjusted to 2.0 mm and 30%, respectively.

Example 4

A sound absorption sheet was manufactured in the same manner as in Example 1 except that the diameter of the sound absorption holes and the ratio of the sound absorption holes per unit area were adjusted to 1 mm and 35%, respectively.

Comparative Example 1

A sheet was prepared by cutting, mixing and needle punching PET fibers as a porous substrate, and then passed through molding rollers. Then, the sheet was subjected to thermoforming, followed by cooling and tripping, thereby manufacturing a PET fiber sound absorption sheet having a thickness of 4 mm.

Comparative Example 2

A glass fiber sound absorption sheet having a thickness of 0.3 mm was prepared in the same manner as in Comparative Example 1 except that glass fibers were used.

Comparative Example 3

An acryl sound absorption sheet including perforations (having an average diameter of 0.5 mm and a porosity of 2%) formed by punching an acryl plate having a thickness of 2 mm was manufactured.

Comparative Example 4

An MDF sound absorption panel, in which a 0.3 mm thick pattern wood plate including pores (having an average diameter of 0.5 mm and a porosity of 2%) formed by drilling was stacked on top of a porous wood plate, was used.

Comparative Example 5

An acryl sound absorption panel, in which 2 mm thick acryl plates including perforations (having an average diameter of 0.5 mm and a porosity of 2%) formed by laser punching were stacked on top and bottom of a 15 mm thick plastic member having a honeycomb structure, was used.

TABLE 1

| | Porous substrate Fiber | Micro-resonance layer: Presence of resonance layer | Micro-resonance layer: Presence of sound absorption holes | Micro-resonance layer: Method of forming sound absorption hole | Sound absorption sheet (panel): Thickness (mm) | Sound absorption sheet (panel): Basis weight (g/m$^2$) |
|---|---|---|---|---|---|---|
| Example 1 | Glass fiber 40%, pulp 55%, PET 5% | Presence | Presence | Rotary screen | 0.65 | 190 |
| Example 2 | Glass fiber 40%, pulp 55%, PET 5% | Presence | Presence | Rotary screen | 0.64 | 192 |
| Example 3 | Glass fiber 40%, pulp 55%, PET 5% | Presence | Presence | Rotary screen | 0.62 | 183 |
| Example 4 | Glass fiber 40%, pulp 55%, PET 5% | Presence | Presence | Rotary screen | 0.63 | 191 |
| Comparative Example 1 | PET fiber | Absence | Absence | — | 4 | 200 |
| Comparative Example 2 | Glass fiber | Absence | Absence | — | 0.3 | 100 |
| Comparative Example 3 | N | Presence | Presence | Drilling | 2 | 1670 |
| Comparative Example 4 | Porous wood | Presence | Presence | Punching | 16 | 6000 |
| Comparative Example 5 | Plastic (honeycomb structure) | Presence | Presence | Laser punching | 19 | 3000 |

Experimental Example

Measurement of Average Sound Absorption Coefficient of Sound Absorption Sheet I. Test Method 1. Test: pipe method (KS F 2814)

2. Test device (Device Name: Model name (manufacturer/country)

Pipe method: HM-02 I/O (Scein/S. Korea)

3. Test temperature/humidity: (19.4, tolerance of 0.3)° C./(59.4, tolerance of 1.9)% R.H.

The pipe method is a method of measuring a sound absorption coefficient of a sound absorbing material by measuring a standing wave when a plane wave is normally incident in a certain direction. This method is also a simple method that can be performed in the case where it is not easy to obtain a specimen. After preparing a specimen having an accurate size, measurement is repeated, thereby minimizing a measurement error. In this experimental example, average sound absorption coefficients over frequency were measured with a back space set to 50 mm.

$$NRC=(a250+a500+a1{,}000+a2{,}000)/4 \quad \text{<Equation>}$$

aX: NRC of XHz (X is a numeral),

Here, since a material has different sound absorption coefficients according to frequency, a single index of sound absorption coefficient representing the material is required in order to indicate sound absorption capability of the material. An NRC (Noise Reduction Coefficient) is a single index to represent a sound absorption coefficient of a material.

TABLE 2

| | 250 | 500 | 750 | 1000 | 1250 | 1500 | 1750 | 2000 |
|---|---|---|---|---|---|---|---|---|
| Example 1 | 0.24 | 0.73 | 0.95 | 0.9 | 0.83 | 0.8 | 0.74 | 0.72 |
| Example 2 | 0.22 | 0.85 | 0.92 | 0.89 | 0.81 | 0.74 | 0.72 | 0.71 |

TABLE 2-continued

| | 250 | 500 | 750 | 1000 | 1250 | 1500 | 1750 | 2000 |
|---|---|---|---|---|---|---|---|---|
| Example 3 | 0.15 | 0.75 | 0.93 | 0.96 | 0.91 | 0.87 | 0.85 | 0.83 |
| Example 4 | 0.1 | 0.4 | 0.84 | 0.83 | 0.81 | 0.77 | 0.75 | 0.7 |
| Comparative Example 1 | 0.09 | 0.18 | 0.3 | 0.4 | 0.5 | 0.61 | 0.62 | 0.63 |
| Comparative Example 2 | 0.07 | 0.14 | 0.17 | 0.25 | 0.3 | 0.37 | 0.4 | 0.41 |
| Comparative Example 3 | 0.11 | 0.63 | 0.4 | 0.27 | 0.24 | 0.15 | 0.13 | 0.12 |
| Comparative Example 4 | 0.25 | 0.55 | 0.42 | 0.4 | 0.53 | 0.35 | 0.33 | 0.3 |
| Comparative Example 5 | 0.1 | 0.43 | 0.82 | 0.72 | 0.55 | 0.4 | 0.35 | 0.3 |

TABLE 3

| | Porous substrate: Basis weight (g/m$^2$) | Porous substrate: Air permeability (L/m$^2$/s) at 50 Pa | Porous substrate: Average Pore size (Capillary Flow Porometer/Model: CFP-1200 AEIL)(μm) | Sound absorption sheet (panel): Air permeability (L/m$^2$/s) at 100 Pa | Sound absorption sheet (panel): Average NRC |
|---|---|---|---|---|---|
| Example 1 | 80 | 135 | 30 | 95 | 0.65 |
| Example 2 | 80 | 135 | 30 | 95 | 0.67 |
| Example 3 | 80 | 135 | 30 | 100 | 0.67 |
| Example 4 | 80 | 135 | 30 | 750 | 0.6275 |
| Comparative Example1 | 200 | — | 85 | Impossible to measure | 0.32 |
| Comparative Example2 | 100 | — | 75 | Impossible to measure | 0.22 |
| Comparative Example3 | — | — | 500 | 45 | 0.28 |
| Comparative Example4 | — | — | — | 100 | 0.375 |

TABLE 3-continued

| | Porous substrate | | | Sound absorption sheet (panel) | |
|---|---|---|---|---|---|
| | Basis weight ($g/m^2$) | Air permeability ($L/m^2/s$) at 50 Pa | Average Pore size (Capillary Flow Porometer/ Model: CFP-1200 AEIL)(μm) | Air permeability ($L/m^2/s$) at 100 Pa | Average NRC |
| Comparative Example5 | — | — | — | 120 | 0.3875 |

Table 3 shows measurement results of average NRCs based on air permeability values (KS K 0570: 2006 test method) and average pore sizes (Capillary Flow Porometer/ Model: CFP-1200 AEIL) of the porous substrates, and air permeability values (KS K 0570:2006 test method) of the sound absorption sheets prepared in Examples and Comparative Examples.

From these results, it could be confirmed that, when the porous substrate had the fiber configuration as in Examples 1 to 4, the sound absorption sheet had an air permeability of about 50 $L/m^2/s$ to about 1000 $L/m^2/s$ at a pressure of 100 Pa, and an average NRC of 0.4 or more, specifically 0.6 or more, in a frequency band of 200 Hz to 2000 Hz.

Conversely, in Comparative Examples 1 and 2, the sound absorption sheets were prepared using the porous sheets having different fiber configurations from those of Examples 1 to 4, and did not include the micro-resonance layer. It was difficult to measure the air permeability of the sound absorption sheet at a pressure of 100 Pa and the sound absorption sheet had an average NRC of less than 0.4 in a frequency band of 200 Hz to 2000 Hz. Further, in Comparative Example 3, the sound absorption sheet including only the micro-resonance layer without the porous substrate was used. This sound absorption sheet had an air permeability of less than 1000 $L/m^2/s$ at a pressure of 100 Pa and an average NRC of less than 0.4. Thus, it could be seen that air permeability and the NRC of the sound absorption sheet not including the porous substrate could not be secured using the micro-resonance layer alone.

However, in Comparative Examples 4 and 5, the sound absorption sheets included the micro-resonance layer on the top of the porous substrate as in Examples 1 to 4, and the micro-resonance layer was formed by drilling, punching, and laser processing as in a typical perforation method, instead of rotary screen printing. Further, in the manufacturing process, the production speed was slower than those of Examples, and the average NRC was less than 0.4. Thus, it could be seen that it was most advantageous in terms of sound absorption capability to employ rotary screen printing when forming the micro-resonance layer.

Further, in Comparative Examples 3 to 5, the perforations formed in the sound absorption panels had a diameter of 0.5 mm and a porosity of 2%. Since these sound absorption panels had a lower number of perforations per unit area than the sound absorption panels of Examples, it can be inferred that rotary screen printing employed in Examples 1 to 4 provides a lower diameter of the sound absorption holes and a higher porosity per unit area than punching, drilling or laser processing employed in Comparative Examples.

As a consequence, it was confirmed through Experimental Example that air permeability and sound absorption capability of the sound absorption sheet were affected by the components of the porous substrate and the presence of the micro-resonance layer. Further, it was confirmed that, even though the sound absorption sheet or panel included the micro-resonance layer having a plurality of sound absorption holes (perforations), the sound absorption capability of the sound absorption sheet or panel varied depending upon the manufacturing process of the micro-resonance layer, specifically, the method of forming the sound absorption holes (perforations). Further, it was confirmed that printing could be used to provide various kinds of sound absorption sheets by controlling the diameters of the various sound absorption holes or the ratio of the sound absorption holes per unit area according to frequency bands.

The invention claimed is:

1. A sound absorption sheet comprising:

a porous substrate comprising a mixture of glass fibers, pulps and polyethylene terephthalate (PET) fibers; and a micro-resonance layer formed by printing, wherein each glass fiber of the glass fibers has a fiber diameter of 5 μm to 20 μm and a fiber length of 1 mm to 50 mm, and wherein the porous substrate has an air permeability of 50 $L/m^2/s$ to 1200 $L/m^2/s$ at a pressure of 50 Pa.

2. The sound absorption sheet according to claim 1, wherein the micro-resonance layer comprises a plurality of sound absorption holes penetrating both surfaces thereof.

3. The sound absorption sheet according to claim 1, wherein the micro-resonance layer comprises at least one selected from among a vinyl chloride sol, a urethane resin, an acrylic resin, and a vinyl resin.

4. The sound absorption sheet according to claim 1, wherein the porous substrate further comprises at least one of cellulose fibers, or a further synthetic fiber.

5. The sound absorption sheet according to claim 1, wherein the porous substrate has a basis weight of 30 $g/m^2$ to 500 $g/m^2$.

6. The sound absorption sheet according to claim 1, wherein the porous substrate has an average pore size of 10 μm to 60 μm.

7. The sound absorption sheet according to claim 1, wherein the sound absorption sheet has an average sound absorption coefficient of 0.4 or more, as measured in a frequency band of 200 Hz to 2000 Hz.

8. The sound absorption sheet according to claim 1, wherein the sound absorption sheet has an air permeability of 50 $L/m^2/S$ to 1200 $L/m^2/s$ at a pressure of 100 Pa.

9. A method for manufacturing a sound absorption sheet, comprising:

preparing a porous substrate comprising a mixture of glass fibers, pulps and PET fibers;

forming a micro-resonance layer on top of the porous substrate by printing; and drying the micro-resonance layer, wherein each glass fiber of the glass fibers has a fiber diameter of 5 μm to 20 μm and a fiber length of 1 mm to 50 mm, and wherein the porous substrate has an air permeability of 50 $L/m^2/s$ to 1200 $L/m^2/s$ at a pressure of 50 Pa.

10. The method according to claim 9, wherein printing includes rotary screen printing.

11. The method according to claim 10, wherein the rotary screen printing comprises injecting a composition for forming the micro-resonance layer into a rotary screen roll, and the rotary screen roll comprises a micro-sound absorption screen.

12. The method according to claim 11, wherein the micro-sound absorption screen controls a diameter of sound absorption holes, a ratio of the sound absorption holes per unit area, or a pitch between the sound absorption holes according to frequency bands.

13. The sound absorption sheet according to claim 4, wherein the porous substrate comprises at least one cellulose fiber selected from the group consisting of wood fibers, cotton fibers, hemp fibers, and Rayon.

14. The sound absorption sheet according to claim 4, wherein the further synthetic organic fiber is at least one selected from the group consisting of polyester, polyethylene (PE), polypropylene (PP), ethylene-styrene copolymer (ES), cycloolefin, polyvinyl alcohol (PVA), ethylene-vinyl acetate (EVA), polyethylene naphthalate (PEN), polyether ether ketone (PEEK), polycarbonate (PC), polysulfone, polyimide (PI), polyacrylonitrile (PAN), styreneacrylonitrile (SAN), and polyurethane (PU).

15. The sound absorption sheet according to claim 1, wherein the porous substrate comprises 40% of glass fibers, 55% of pulp and 5% of PET fibers.

* * * * *